US011808557B2

(12) United States Patent
Do et al.

(10) Patent No.: US 11,808,557 B2
(45) Date of Patent: Nov. 7, 2023

(54) COVER STRUCTURE WITH DOUBLE COVER STRUCTURE AND SHOOTING CASE OF MUNITION HAVING SAME

(71) Applicant: HANWHA CORPORATION, Seoul (KR)

(72) Inventors: Ki Won Do, Daejeon (KR); Hwan Seok Choi, Daejeon (KR); Woon Soon Lee, Daejeon (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 373 days.

(21) Appl. No.: 17/101,095

(22) Filed: Nov. 23, 2020

(65) Prior Publication Data

US 2021/0231419 A1 Jul. 29, 2021

(30) Foreign Application Priority Data

Jan. 29, 2020 (KR) ..... 10-2020-0010194

(51) Int. Cl.
*F42B 5/26* (2006.01)
*F42B 39/20* (2006.01)

(52) U.S. Cl.
CPC ..... *F42B 5/26* (2013.01); *F42B 39/20* (2013.01)

(58) Field of Classification Search
CPC ..... F42B 39/20; F42B 39/26
USPC ..... 86/50; 89/1.817, 1.816; 220/325, 316, 220/319
See application file for complete search history.

(56) References Cited

U.S. PATENT DOCUMENTS 5,501,357 A * 3/1996 Fullin ..... B65D 51/145 220/325

FOREIGN PATENT DOCUMENTS

KR 10-2013-0097396 A 9/2013
KR 10-2019-0070084 A 6/2019

* cited by examiner

*Primary Examiner* — Reginald S Tillman, Jr.
(74) *Attorney, Agent, or Firm* — WHDA, LLP

(57) ABSTRACT

Proposed is a cover structure with a double cover structure and a shooting case of munition having the same. The cover structure with a double cover structure includes: a shooting case main body having an inner space with an open upper side; a cover member seated on the open upper side of the shooting case main body to seal the open upper side; and a cover fixing member coupled to the shooting case main body to fix a position of the cover member, so that the position of the cover member is strongly fixed while simplifying a structure by the double cover structure to increase an internal pressure of the shooting case, thereby increasing a range of munition and maintaining performance of munition.

9 Claims, 8 Drawing Sheets

COVER STRUCTURE WITH DOUBLE COVER STRUCTURE AND SHOOTING CASE OF MUNITION HAVING SAME

CROSS REFERENCE TO RELATED APPLICATION(S)

This application claims the benefit of Korean Patent Application No. 10-2020-0010194, filed Jan. 29, 2020, which is hereby incorporated by reference in its entirety into this application.

BACKGROUND OF THE DISCLOSURE

1. Technical Field

The present disclosure relates to a cover structure with a double cover structure and a shooting case of munition having the same and, more specifically, to a cover structure with a double cover structure which prevents left and right rotation by a double taper structure to increase internal pressure and reduce manufacturing costs, and to a shooting case of munition having the same.

2. Description of the Related Art

In general, remote controlled munition is a strategic weapon used for receiving a signal wirelessly to shoot munition disposed in a shooting case to kill men and horses.

The remote controlled munition is operated in a manner that pressure is generated in the shooting case when the munition is shot from the shooting case and the munition is shot by the internal pressure upon opening a cover when the internal pressure exceeds a predetermined pressure.

An existing shooting case fixes the cover with six shear pins to maintain a coupling state of the cover until the internal pressure is increased to the predetermined pressure.

FIG. 1 is a view illustrating a cover structure of an existing shooting case. With reference to FIG. 1, the shooting case includes a shooting case member 10 having munition disposed therein and having one open side and a cover member 20 coupled to the one open side to seal the shooting case member 10.

In addition, pin through-holes 11 are formed at intervals on an outer circumference of the shooting case member 10 and pin insertion groove parts 21 corresponding to the pin through-holes 11 are formed on an outer circumference of the cover member 20.

The cover member 20 is fixed by a plurality of shear pins 30 coupled into the pin insertion groove parts 21 through the pin through-holes 11, respectively.

The existing shooting case fixes the cover member 20 by the six shear pins to fix a warhead and releases a fixing structure through shearing of the shear pins when a shooting signal is applied so that the warhead is shot.

However, since the existing shooting case fixes the cover member 20 by the plurality of shear pins 30, which are the six shear pins 30, it is limited to increase the internal pressure so that there is a problem of a short range of munition.

In addition, since a position of the cover member 20 is fixed by the plurality of shear pins 30, manufacturing costs are increased, and process becomes complex and excessive man-hour is required due to an assembly process of the shear pins, so that there is a problem that productivity is decreased.

SUMMARY OF THE DISCLOSURE

An objective of the present disclosure is to provide a cover structure with a double cover structure which may provide similar performance to that of an existing shooting case using a shear pin by the double cover structure, and to a shooting case of munition having the same.

Another objective of the present disclosure is to provide a cover structure with a double cover structure which may simplify an assembly process and reduce manufacturing costs without using a shear pin, and to a shooting case of munition having the same.

To achieve this one embodiment of a cover structure with a double cover structure of the present disclosure may include: a shooting case main body having an inner space with an open upper side; a cover member seated on the open upper side of the shooting case main body to seal the open upper side; and a cover fixing member coupled to the shooting case main body to fix a position of the cover member.

To achieve this, one embodiment of a shooting case of munition of the present disclosure may include: a shooting case main body having an inner space with an open upper side; an explosive body disposed inside the shooting case main body; a cover member seated on the open upper side of the shooting case main body to seal the open upper side; and a cover fixing member coupled to the shooting case main body to fix a position of the cover member.

According to the present disclosure, the cover fixing member may be screw-coupled to an upper side of the shooting case main body and press the cover member to fix the position of the cover member.

According to the present disclosure, a conic munition insertion part into which a part of the explosive body is inserted and having a diameter gradually decreased toward an upper side may be disposed on a lower surface of the cover member.

The one embodiment of a shooting case of munition according to the present disclosure may further include a munition shock absorption member disposed between a lower surface of the cover member and an upper part of the explosive body.

According to the present disclosure, the cover fixing member may be formed in a circular ring shape that has one portion overlapped with and screw-coupled to the shooting case main body and has a remaining portion with a height capable of surrounding and supporting an outer circumferential surface of the cover member, a first screw-coupling part may be disposed on an inner circumferential surface of a lower end side, and a second screw-coupling part having a thread formed on an outer circumferential surface to be engaged with the first screw-coupling part may be disposed on an upper end part of the shooting case main body.

According to the present disclosure, the cover fixing member may have a cover locking part formed on an upper end side to lock and fix the upper surface of the cover member.

According to the present disclosure, a plurality of cover locking parts may be provided and disposed to be spaced apart from each other in a circumferential direction to lock and fix the upper surface of the cover member.

According to the present disclosure, the plurality of cover locking parts may be spaced apart from a center of the cover fixing member at predetermined angles, thereby being disposed to be spaced apart from each other at equal angles to uniformly distribute and support a pressure applied to the cover member.

According to the present disclosure, the cover member may include: a shooting case insertion part inserted into the shooting case main body; a shooting case receiving part disposed on an upper side of the shooting case insertion part and disposed to protrude to the outside of the shooting case insertion part to be seated on the upper end part of the shooting case; and a locking support protrusion part disposed to protrude on the upper surface of the shooting case receiving part and having a locking step part formed on an outer circumference to allow the cover locking part to be locked thereto.

According to the present disclosure, the cover locking part may include: a first locking part protruding to an inner circumferential surface of the cover fixing member; and a second locking part disposed to protrude from an end side of the first locking part to a lower side.

According to the present disclosure, an inner circumferential surface of the second locking part may come in contact with an outer circumferential surface of the locking support protrusion part to be supported thereby.

According to the present disclosure, an O-ring insertion groove may be disposed on the outer circumferential surface of the shooting case insertion part, and the one embodiment of a cover structure with a double cover structure and the one embodiment of a shooting case of munition according to the present disclosure may further include a first O-ring member inserted into the O-ring insertion groove to seal the inside of the shooting case main body.

According to the present disclosure, the cover locking part may include a first locking part protruding to the inner circumferential surface of the cover fixing member and a second locking part disposed to protrude from the end side of the first locking part to a lower part, and the one embodiment of a cover structure with a double cover structure and the one embodiment of a shooting case of munition according to the present disclosure may further include a second O-ring member disposed in a space formed between the inner circumferential surface of the cover fixing member and the outside of the second locking part.

According to the present disclosure the position of the cover member is strongly fixed while simplifying a structure by the double cover structure, so that an internal pressure of the shooting case is increased, thereby providing effects of increasing a range of munition and maintaining performance of munition.

In addition, a sealing structure of the cover is simplified by the double cover structure without using a shear pin, so that manufacturing costs and assembly man-hour are reduced, thereby providing an effect of significantly increasing productivity.

DESCRIPTION OF THE PREFERRED EMBODIMENTS

Hereinafter, the present disclosure will be described in detail.

A preferred embodiment of the present disclosure will be described in detail with reference to attached drawings. Prior to this terms or words used in the present specification and claims should not be construed as being limited to the ordinary or dictionary meanings. Accordingly, since the embodiments described in the specification and configuration shown in drawings are only the most preferred embodiment of the present disclosure and do not represent all of the technical idea of the present invention, it should be understood that there may be various equivalents and variations that may be substituted for them at the time of the present disclosure.

Figure 1:
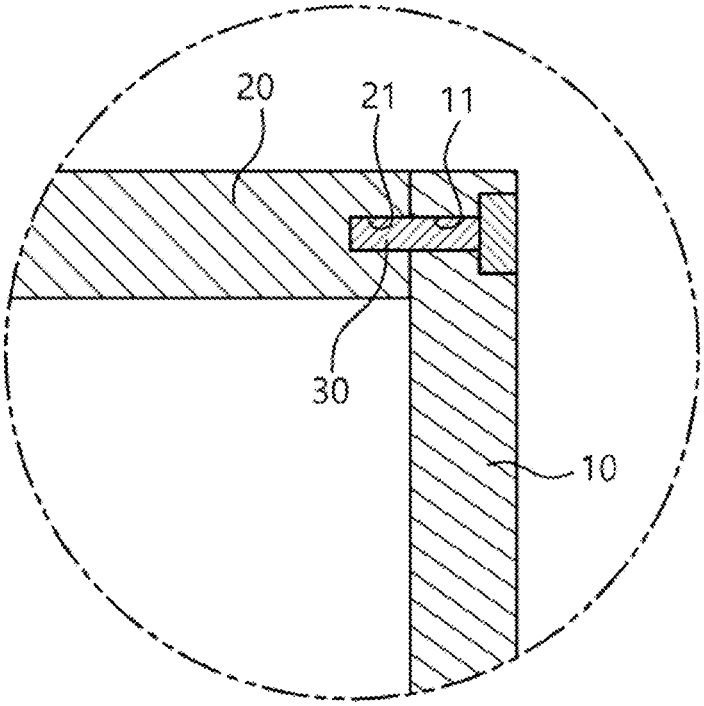
FIG. 1 is a sectional view illustrating a cover structure of an existing shooting case.
Figure 2:
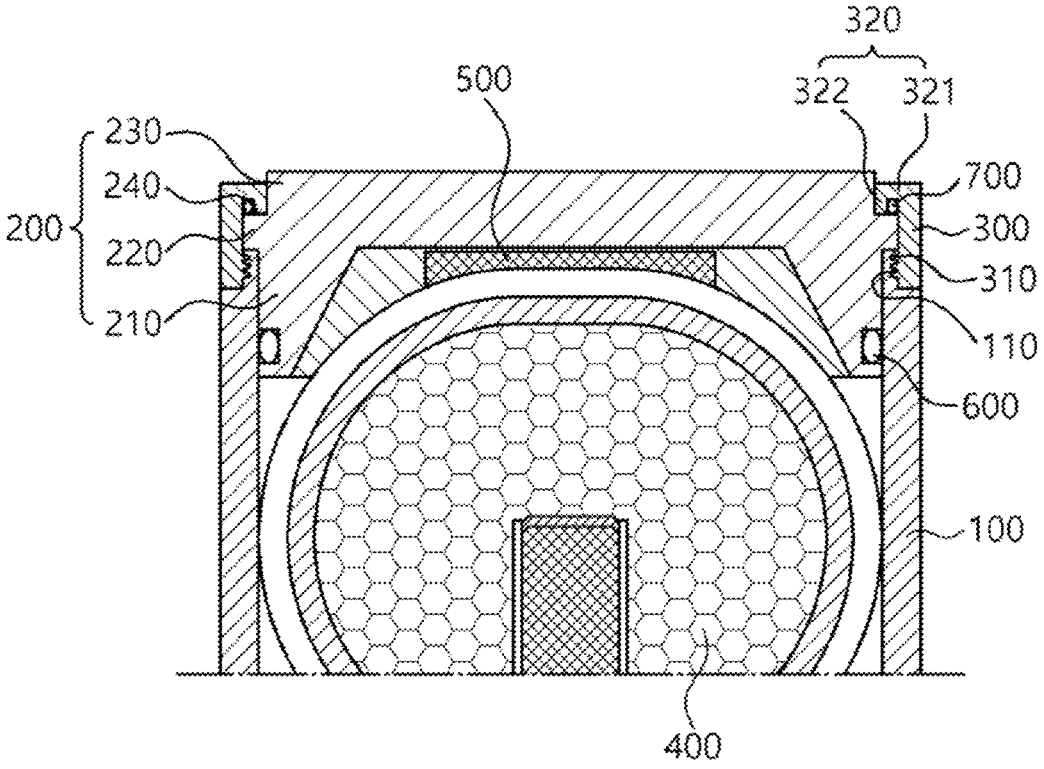
FIG. 2 is a sectional view illustrating one embodiment of a shooting case of munition according to the present disclosure.
Figure 3:
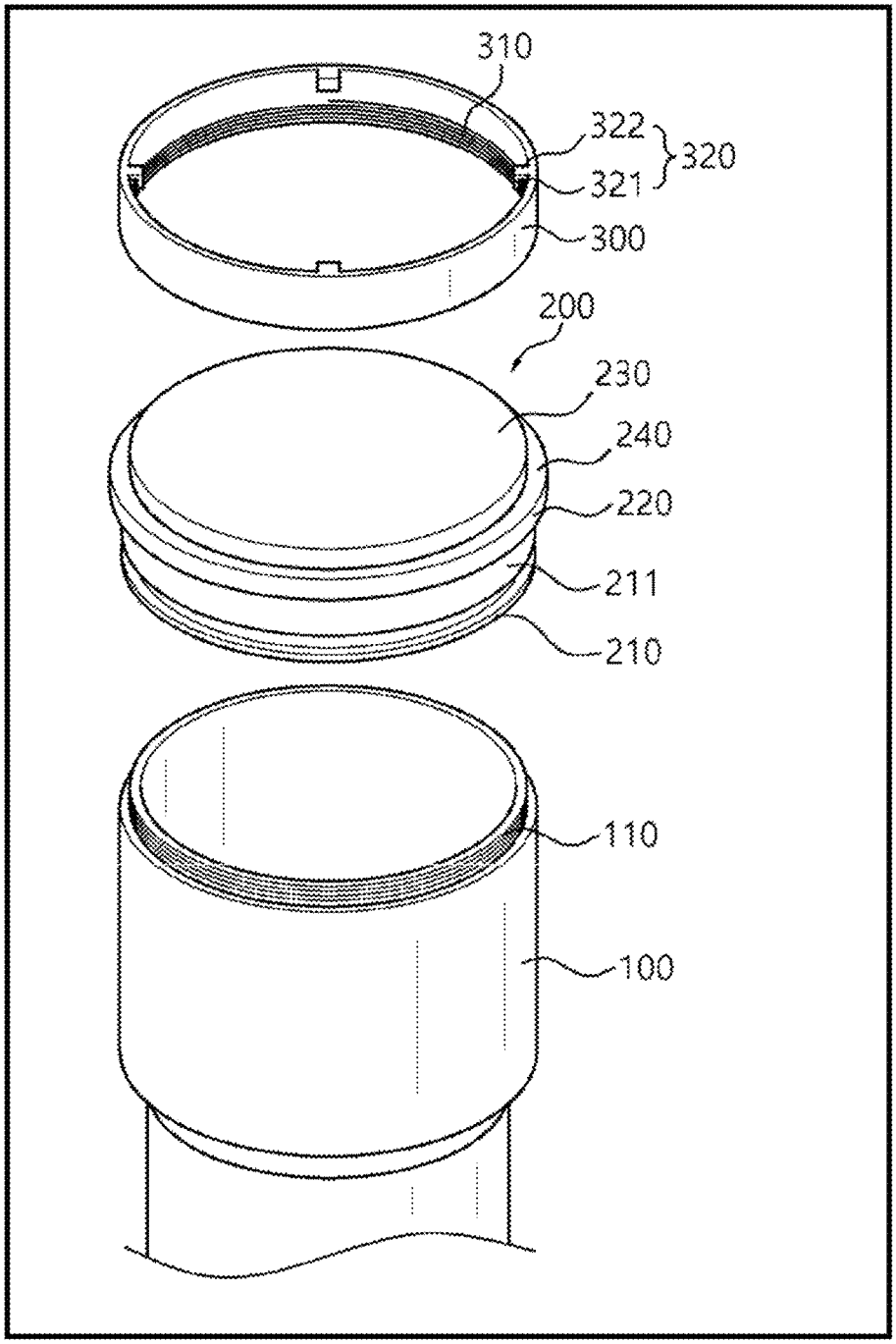
FIG. 3 is an exploded perspective view illustrating a cover structure with a double cover structure according to the present disclosure.
Figure 4:
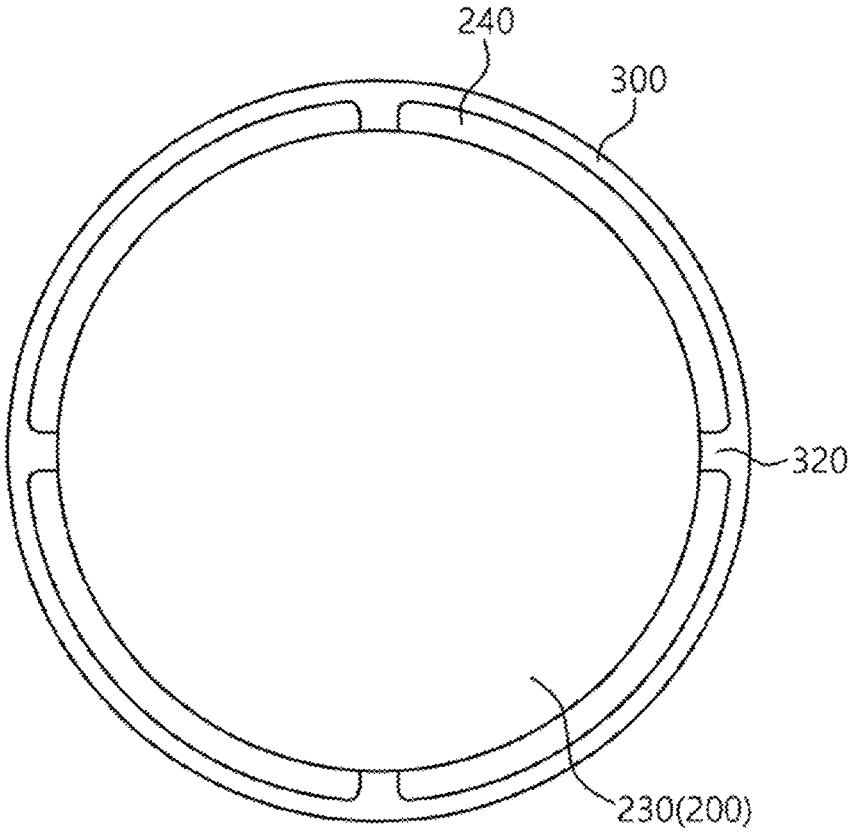
FIG. 4 is a plan view illustrating a cover structure with a double cover structure according to the present disclosure.

FIG. 2 is a sectional view illustrating one embodiment of a shooting case of munition according to the present disclosure, FIG. 3 is an exploded perspective view illustrating a cover structure with a double cover structure according to the present disclosure, and FIG. 4 is a plan view illustrating a cover structure with a double cover structure according to the present disclosure.

With reference to FIGS. 2, 3, and 4, the one embodiment of a cover structure with a double cover structure and the one embodiment of a shooting case of munition having the same according to the present disclosure will be described in detail.

The one embodiment of a cover structure with a double cover structure and the one embodiment of a shooting case of munition having the same according to the present disclosure include: a shooting case main body 100 having an inner space with an open upper side; and a cover member 200 seated on the open upper side of the shooting case main body 100 to seal the upper side of the shooting case main body 100.

The position of the cover member 200 is fixed when the cover member 200 is seated on the upper part of the shooting case main body 100 by a cover fixing member 300 coupled to the shooting case main body 100.

The cover fixing member 300 is corresponding to the shooting case main body 100 and presses the cover member 200 seated on an upper end part of the shooting case main body 100 to tightly seal the inside of the shooting case main body 100.

The open upper side of the shooting case main body 100 is illustrated on the basis of a direction illustrated in drawings, which is a relative direction that means a direction in which the cover member 200 is coupled to be opened and close, and thus it should be noted that the direction does not mean the upper side unconditionally.

In addition, the one embodiment of the present disclosure, the shooting case of munition may further include an explosive body 400 disposed inside the shooting case main body 100.

On the other hand, for example, the explosive body 400 is remote controlled munition that receives a signal wirelessly to shoot munition disposed in the shooting case main body 100.

In addition, the cover member 100 performs a function that presses the explosive body 400 in the shooting case main body 100 to fix a position of the explosive body 400.

Accordingly, since the explosive body 400 is placed at a correct position, it is prevented that a malfunction is generated in detonation and the explosive body 400 will be stably detonated.

The shooting case of munition according to the present disclosure may further include a munition shock absorption member 500 disposed between a lower surface of the cover member 200 and an upper part of the explosive body 400.

For example, the munition shock absorption member 500 is made of felt and is compressed when the explosive body 400 is pressed by the cover member 200 to absorb a pressure applied to the explosive body 400 so that the position of the explosive body 400 may be stably fixed.

A conic munition insertion part allowing one part of the explosive body 400 to be inserted thereinto and having a diameter gradually decreased toward an upper side is disposed on the lower surface of the cover member 200.

The conic munition insertion part performs a role of concentrating an internal pressure of the shooting case main body 100 on the open upper side of the shooting case main body 100 after detonation of the explosive body 400 to smoothly separate the cover member 200 at a predetermined pressure and increasing a range of the explosive body 400.

For example, the cover fixing member 300 is screw-coupled to the upper side of the shooting case main body 100 and presses the cover member 200 to fix the position of the cover member 200.

A first screw-coupling part 310 is disposed on an inner circumferential surface of a lower end side of the cover fixing member 300 and a second screw-coupling part 110 having a thread formed on an outer circumferential surface to be screw-coupled to the first screw-coupling part 310 is disposed on an outer circumferential surface of the upper end part of the shooting case main body 100.

Although not shown, the first screw-coupling part 310 may be disposed on an outer circumferential surface of the lower end side of the cover fixing member 300 and the second screw-coupling part 110 having a thread form on an inner circumferential surface to be screw-coupled to the first screw-coupling part 310 may be disposed on the upper end part of the shooting case main body 100.

The cover fixing member 300 is coupled to the shooting case main body 100 in a screw-coupling manner, thereby simplifying an assembly process and being easily designed to be separated from the shooting case main body 100 when the internal pressure of the shooting case main body 100 reaches a predetermined pressure.

On the other hand, the cover fixing member 300 includes a cover locking part 320 formed on the upper end side to lock and fix the upper surface of the cover member 200.

A plurality of cover fixing members 300 are provided and spaced apart from each other in a circumferential direction to lock and fix the upper surface of the cover member 200.

For example, the shooting case main body 100 has a cylindrical body and the cover fixing member 300 has a ring body with a circular hollow portion capable of being screw-coupled to the shooting case main body 100 having the cylindrical body.

One portion of the cover fixing member 100 is overlapped with and screw-coupled to the shooting case main body 100 and a remaining portion thereof is formed in a circular ring shape having a height capable of surrounding and supporting the outer circumferential surface of the cover member 200, so that the position of the cover member 200 may be stably fixed.

The cover member 200 may include: a shooting case insertion part 210 inserted into the shooting case main body 100 and a shooting case reception part 200 disposed on the upper side of the shooting case insertion part 210 and disposed to protrude to the outside of the shooting case insertion part 210 to be seated on the upper end part of the shooting case main body 100.

The shooting case insertion part 210 is disposed to allow an outer circumferential surface to be closely attached to an inner circumferential surface of the shooting case main body 100 and, more specifically, has an outer diameter of the same size as the size of an inner diameter of the shooting case main body 100 so that the entire outer circumferential surface is disposed to be closely attached to the inner circumferential surface of the shooting case main body 100.

In addition, for example the shooting case reception part 220 is disposed to be closely attached to the inner circumferential surface of the cover fixing member 300 more specifically, the outer diameter of the shooting case reception part 220 has the same size as the size of the inner diameter of the cover fixing member 300 so that the entire outer circumferential surface of the shooting case reception part 220 is disposed to be closely attached to the inner circumferential surface of the cover fixing member 300.

The shooting case insertion part 210 is disposed to be closely attached to the inner circumferential surface of the shooting case main body 100, the shooting case reception part is disposed to be closely attached to the inner circumferential surface of the cover fixing member 300 and thus airtightness of the shooting case main body 100 may be stably maintained and the position of the cover member 200 may be stably fixed.

The cover member 200 may further include a locking support protrusion part 230 disposed to protrude to the upper surface of the shooting case reception part 220 and having a locking step part 240 formed on an outer circumference to allow a cover locking part 320 to be locked thereto.

The locking support protrusion part 230 protrudes from the center of the shooting case reception part 220 to the upper surface of the shooting case reception part 220, wherein the locking step parts 240 with equal widths are formed on an outer circumference by a circular protrusion part having a smaller diameter than a diameter of the shooting case reception part 220.

A plurality of cover locking parts 320 are spaced apart from each other at predetermined angles with respect to the center of the cover fixing member 300, wherein the plurality of cover locking parts 320 are disposed to be spaced apart from each other at equal angles to uniformly distribute and support a pressure applied to the cover member 200.

In addition, a plurality of locking protrusion parts are disposed to be spaced apart from each other at equal angles with respect to the center of the cover fixing member 300 to be simultaneously broken by the internal pressure of the shooting case main body 100 after the detonation of the explosive body 400.

For example, the plurality of locking protrusion parts are disposed to four positions at intervals of 90° with respect to the center of the cover fixing member 300.

A conic munition insertion part is disposed on the lower surface of the shooting case insertion part 210 and the conic munition insertion part concentrates the internal pressure of the shooting case main body 100 on the open upper side of the shooting case main body 100 from the center of the cover member 200 after the detonation of the explosive body 400 so that the plurality of locking protrusion parts spaced apart from each other at the equal angles are simultaneously cut and thus the cover member 220 is separated from the shooting case main body 100.

The cover locking part 320 may include a first locking part 321 protruding to the inner circumferential surface of the cover fixing member 300 and a second locking part 322 disposed to protrude from an end side of the first locking part 321 to a lower side.

The first locking part 321 vertically protrudes to the inner circumferential surface of the cover fixing member 300 to be disposed in parallel to the upper surface of the cover member 200 and the second locking part 322 vertically protrudes to the lower side of the cover fixing member 300 to allow a lower end part to be seated on the locking step part 240.

The second locking part 322 is seated on the upper surface of the locking step part 240 to press the cover member 200 when the cover fixing member 300 is screw-coupled to the shooting case main body 100 so that the position of the cover member 200 is strongly fixed.

Moreover, the inner circumferential surface of the second locking part 322 comes in contact with and are supported to the outer circumferential surface of the locking support protrusion part 230 so that the cover member 200 may be further strongly locked and supported.

An O-ring insertion groove part 211 is disposed on the outer circumferential surface of the shooting case insertion part 210 and the one embodiment of a cover structure with a double cover structure and a shooting case of munition according to the present disclosure may further include a first O-ring member 600 inserted into the O-ring insertion groove part 211 to seal the inside of the shooting case main body 100.

The first O-ring member 600 seals the inside of the shooting case main body 100 to increase the internal pressure of the shooting case main body 100 without leakage after the detonation of the explosive body 400.

In addition, the second locking part 322 forms a space with the inner circumferential surface of the cover fixing member 300 on the outside of the second locking part 322 while protruding to the lower side of the cover fixing member 300.

Moreover, the second O-ring member 700 is inserted into the space between the second locking part 322 and the cover fixing member 300, thereby surely sealing the inside of the shooting case main body 100 and preventing an internal pressure loss of the shooting case main body 100 after the detonation of the explosive body 400.

The shooting case of munition according to the present disclosure should maintain the cover member 200 in a sealed state until the internal pressure of the shooting case main body 100 reaches the predetermined pressure and should exactly separate the cover member 200 from the shooting case main body 100 at the predetermined pressure thereby providing the internal explosive body 400 with a range as much as a target distance and allowing the explosive body 400 to efficiently hit a target.

Accordingly due to a double cover structure of the cover member 200 and the cover fixing member 300, the shooting case of munition according to the present disclosure may maintain airtightness of the shooting case main body 100 and exactly separate the cover member 200 from the shooting case main body 100 at a point of time when the cover member 200 is separated, which is a predetermined pressure.

FIGS. 5, 6, 7A, and 7B are views illustrating structural analysis results with respect to an embodiment of a shooting case of munition according to the present disclosure and a comparative example of the present disclosure and the comparative example of the present disclosure is an existing munition shooting case structure using a shear pin.

Figure 5:
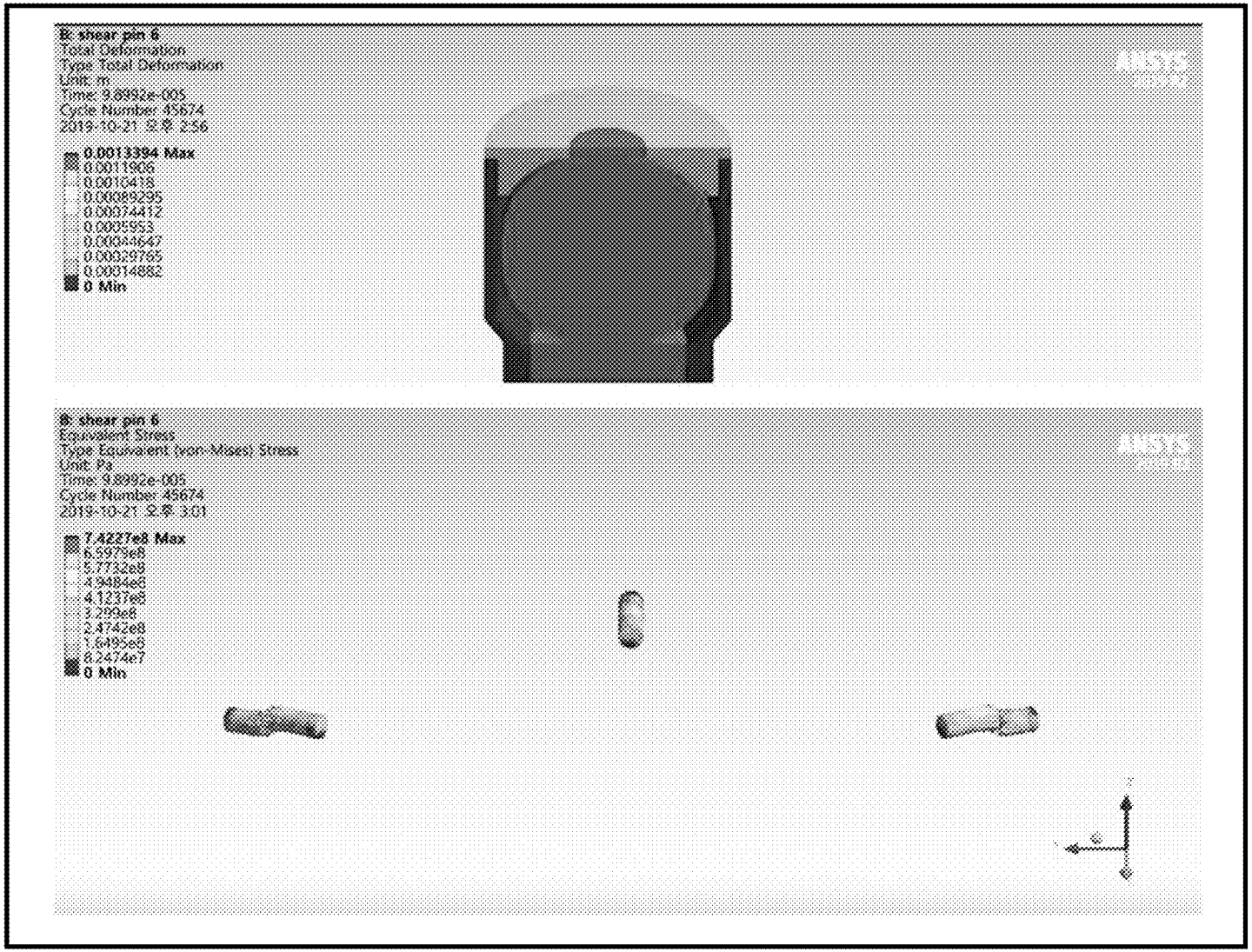
FIGS. 5, 6, 7A, and 7B are views illustrating structural analysis results with respect to an embodiment of a shooting case of munition according to the present disclosure and a comparative example of the present disclosure.
Figure 6:
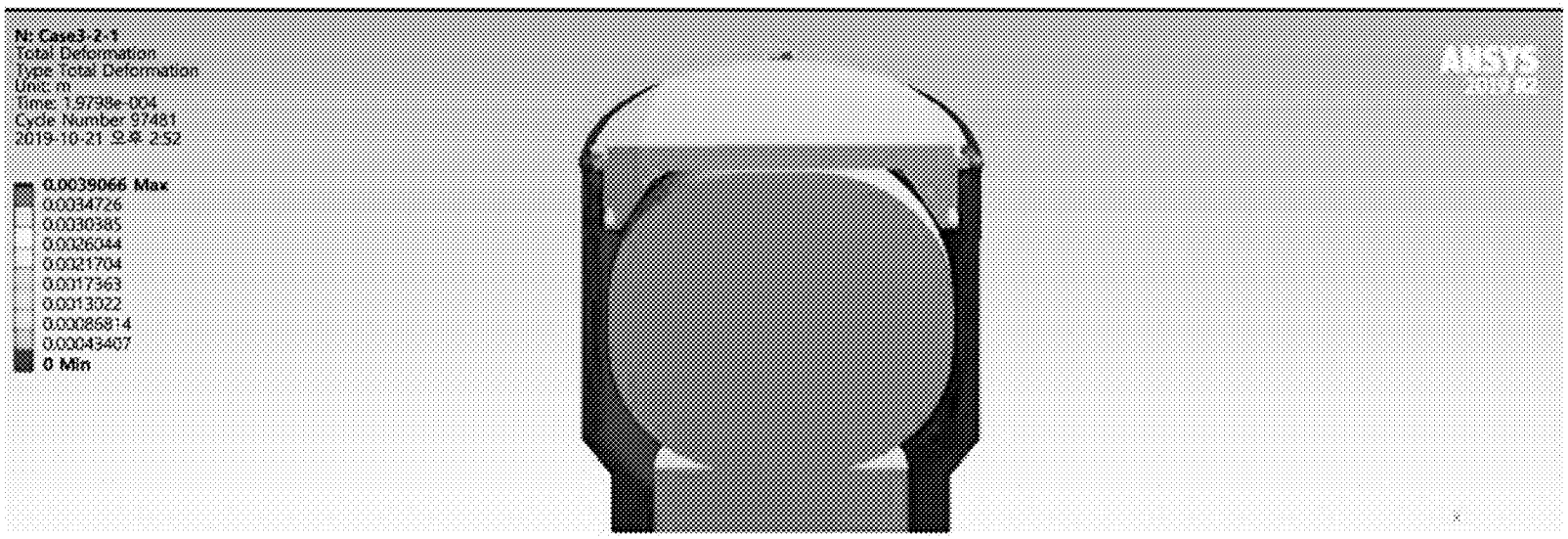
Figure 7A:
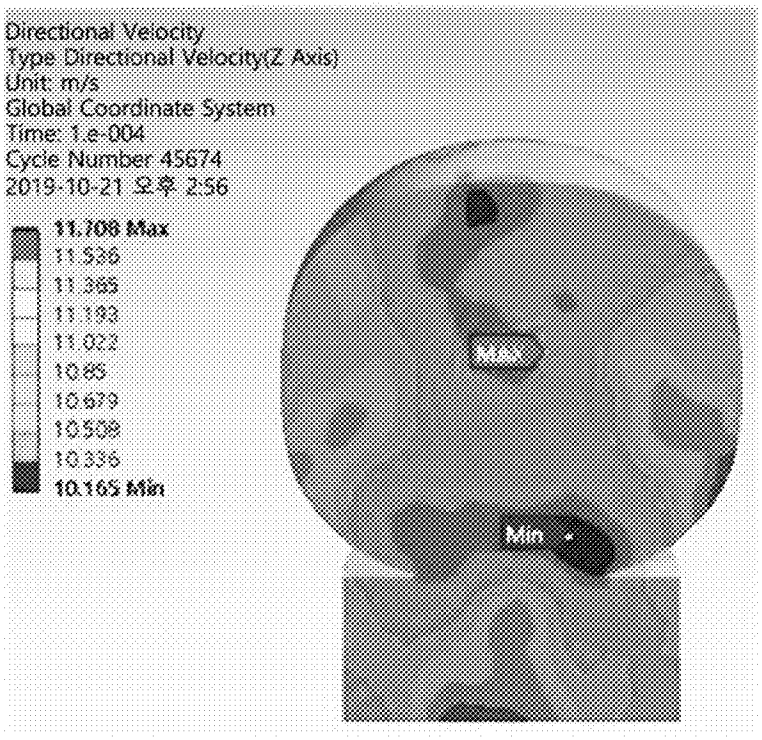
Figure 7B:
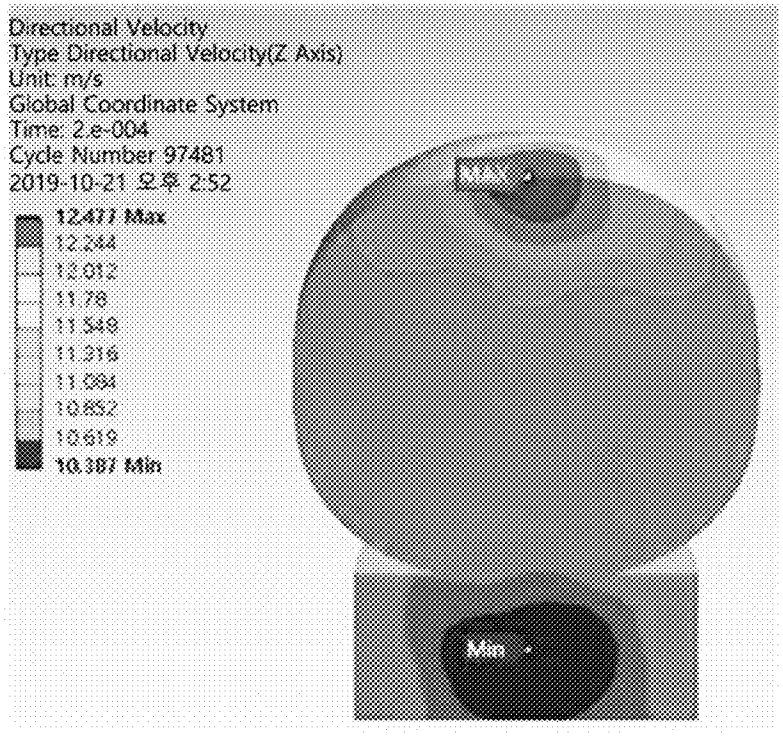

More specifically, FIGS. 5 and 7A are views illustrating structural analysis results with respect to an existing munition shooting case structure using a plurality of shear pins and FIGS. 6 and 7B are views illustrating structural analysis results with respect to the embodiment of a shooting case of munition according to the present disclosure including four cover locking parts 320 disposed to be spaced at intervals of 90°.

Figure 8:
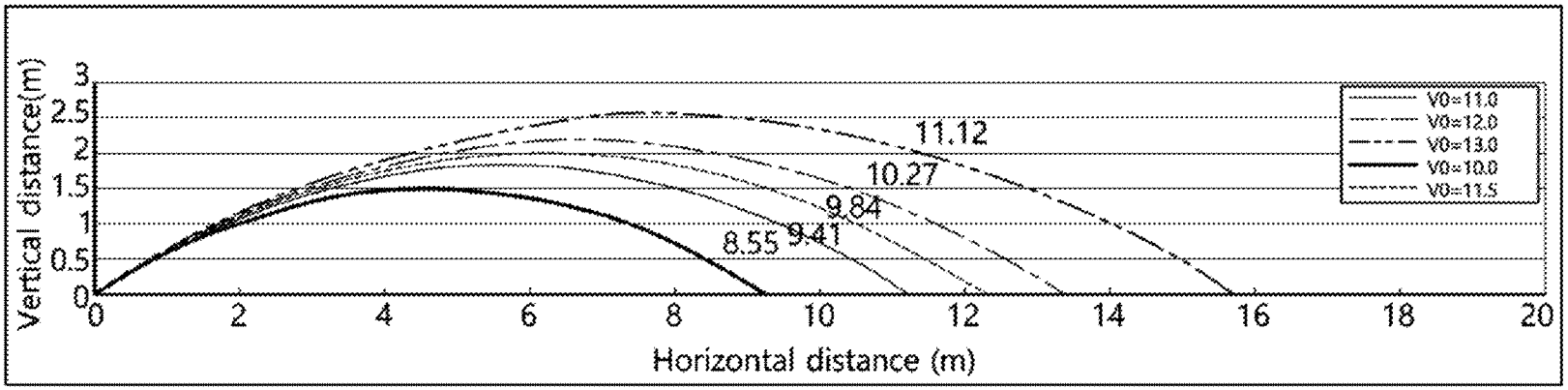
FIG. 8 is a graph illustrating an average projection speed and a range of munition.

In addition, FIG. 8 is a graph illustrating an average projection speed and a range of munition. With reference to FIG. 8, it is checked that the explosive body 400 reaches a predetermined target distance when the average projection speed of the explosive body 400 is in a range of 11.0 to 11.5 m/s.

As illustrated in the structural analysis results of FIGS. 5 and 7A with respect to the existing munition shooting case structure using a plurality of shear pins, an average projection speed (Vag) of the explosive body 400 in the existing munition shooting case is 11.0 m/s. However, as illustrated in the structural analysis results of FIGS. 6 and 7B with respect to the embodiment of a shooting case of munition according to the present disclosure, an average projection speed (Vag) of the explosive body 400 in the shooting case of munition according to the present disclosure is 11.3 m/s, so it is checked that more excellent effect than existing performance is acquired without the shear pin.

According to the present disclosure the position of the cover member is strongly fixed while simplifying a structure by a double cover structure, so that an internal pressure of a shooting case is increased, thereby providing effects of increasing a range of munition and maintaining performance of munition.

In addition, a sealing structure of the cover is simplified by the double cover structure without using a shear pin, so that manufacturing costs and assembly man-hour are reduced, thereby providing an effect of significantly increasing productivity.

The present disclosure is not limited to the above-described embodiments, and various changes can be made without departing from the gist of the present disclosure, which is understood to be included in the configuration of the present disclosure.

What is claimed is:

1. A cover structure with a double cover structure, the cover structure comprising:

a shooting case main body having an inner space with an open upper side;

a cover member seated on the open upper side of the shooting case main body to seal the open upper side; and a cover fixing member coupled to the shooting case main body to fix a position of the cover member, wherein the cover fixing member has a cover locking part formed on an upper end side thereof to lock and fix the upper surface of the cover member, wherein the cover locking part comprises a plurality of cover locking parts disposed to be spaced apart from each other in a circumferential direction to lock and fix the upper surface of the cover member, and wherein the cover locking parts comprise:

a first locking part protruding to an inner circumferential surface of the cover fixing member; and a second locking part disposed to protrude from an end side of the first locking part to a lower side.

2. The cover structure of claim 1, wherein the cover fixing member is screw-coupled to the upper side of the shooting case main body and presses the cover member to fix the position of the cover member.

3. The cover structure of claim 1, wherein a conic munition insertion part having a diameter gradually decreased toward the upper side thereof is placed on a lower surface of the cover member.

4. The cover structure of claim 1, wherein the cover fixing member is formed in a circular ring shape that has one portion overlapped with and screw-coupled to the shooting case main body and has a remaining portion with a height capable of surrounding and supporting an outer circumferential surface of the cover member, a first screw-coupling part is disposed on an inner circumferential surface of a lower end side of the cover fixing member, and a second screw-coupling part having a thread on an outer circumferential surface thereof to be engaged with the first screw-coupling part is disposed on an upper end part of the shooting case main body.

5. The cover structure of claim 1, wherein the plurality of cover locking parts are spaced apart from a center of the cover fixing member at predetermined angles, thereby being disposed to be spaced apart from each other at equal angles to uniformly distribute and support a pressure applied to the cover member.

6. The cover structure of claim 1, wherein the cover member comprises:

a shooting case insertion part inserted into the shooting case main body;

a shooting case receiving part disposed on an upper side of the shooting case insertion part and disposed to protrude to the outside of the shooting case insertion part to be seated on an upper end part of the shooting case; and a locking support protrusion part disposed to protrude from an upper surface of the shooting case receiving part and having a locking step part formed on an outer circumference thereof to allow the cover locking parts to be locked thereto.

7. The cover structure of claim 1, wherein an inner circumferential surface of the second locking part comes in contact with an outer circumferential surface of the locking support protrusion part to be supported thereby.

8. The cover structure of claim 6, wherein an O-ring insertion groove part is disposed on an outer circumferential surface of the shooting case insertion part, and the cover member further comprises a first O-ring member inserted into the O-ring insertion groove to seal the inside of the shooting case main body.

9. The cover structure of claim 8, wherein the cover locking parts comprises:

a first locking part protruding to an inner circumferential surface of the cover fixing member;

a second locking part disposed to protrude from an end side of the first locking part to a lower part; and a second O-ring member disposed in a space formed between the inner circumferential surface of the cover fixing member and the outside of the second locking part.

* * * * *